US005140729A

United States Patent [19]

Simmen

[11] Patent Number: 5,140,729

[45] Date of Patent: Aug. 25, 1992

[54] DEVICE FOR BLOW-TEXTURING AT LEAST ONE MULTIFILAMENT YARN

[75] Inventor: Christian Simmen, Schönengrund, Switzerland

[73] Assignee: Heberlein Maschinenfabrik AG, Wattwil, Switzerland

[21] Appl. No.: 675,895

[22] PCT Filed: Aug. 24, 1990

[86] PCT No.: PCT/CH90/00199

§ 371 Date: May 2, 1991

§ 102(e) Date: May 2, 1991

[87] PCT Pub. No.: WO91/03586

PCT Pub. Date: Mar. 21, 1991

[30] Foreign Application Priority Data

Sep. 5, 1989 [CH] Switzerland ..... 3218/89-0

[51] Int. Cl.[5] ..... D02G 1/16; D02G 1/12; D02J 1/08

[52] U.S. Cl. ..... 28/271; 28/273; 28/274; 28/275; 28/254

[58] Field of Search ..... 28/271, 273, 274, 275, 28/254

[56] References Cited

U.S. PATENT DOCUMENTS 3,328,863 7/1967 Cobb et al. ..... 28/273
3,380,242 4/1968 Richmond et al. ..... 28/273 X
3,477,217 11/1969 Bell et al. ..... 28/271 X
3,577,614 5/1971 Price ..... 28/273 X
3,805,343 4/1974 Ethridge ..... 28/273
4,041,583 8/1977 Hart et al. ..... 28/254
4,107,828 8/1978 Clendening, Jr. et al. ..... 28/254
4,667,380 5/1987 Symon ..... 28/271
4,922,593 5/1990 Gorrafa ..... 28/273 X

FOREIGN PATENT DOCUMENTS 1230171 12/1966 Fed. Rep. of Germany .

*Primary Examiner*—Werner H. Schroeder
*Assistant Examiner*—Bibhu Mohanty
*Attorney, Agent, or Firm*—Young & Thompson

[57] ABSTRACT

The device has a guide unit (1) enclosing a through hole with a conical inlet section (2). A needle unit (3) encloses a through yarn passage (4) arranged coaxially with the hole in the guide unit (1). One end of the needle unit (3) extends into the conical inlet section (2) and has a conical peripheral area (5) which, with the wall of the inlet section (2), forms a slot (6) for a blowing agent. The blowing agent is fed through a drilling (17) opening into the annular space (18) surrounding the needle unit (3) are pressed together by an elastic load, e.g. springs (11, 12). This arrangement accurately fixes the axial position of the guide unit (1) in relation to the needle unit (3), while the width of the slot (6) is accurately predetermined and unchangeable.

9 Claims, 4 Drawing Sheets

DEVICE FOR BLOW-TEXTURING AT LEAST ONE MULTIFILAMENT YARN

Figure 1:
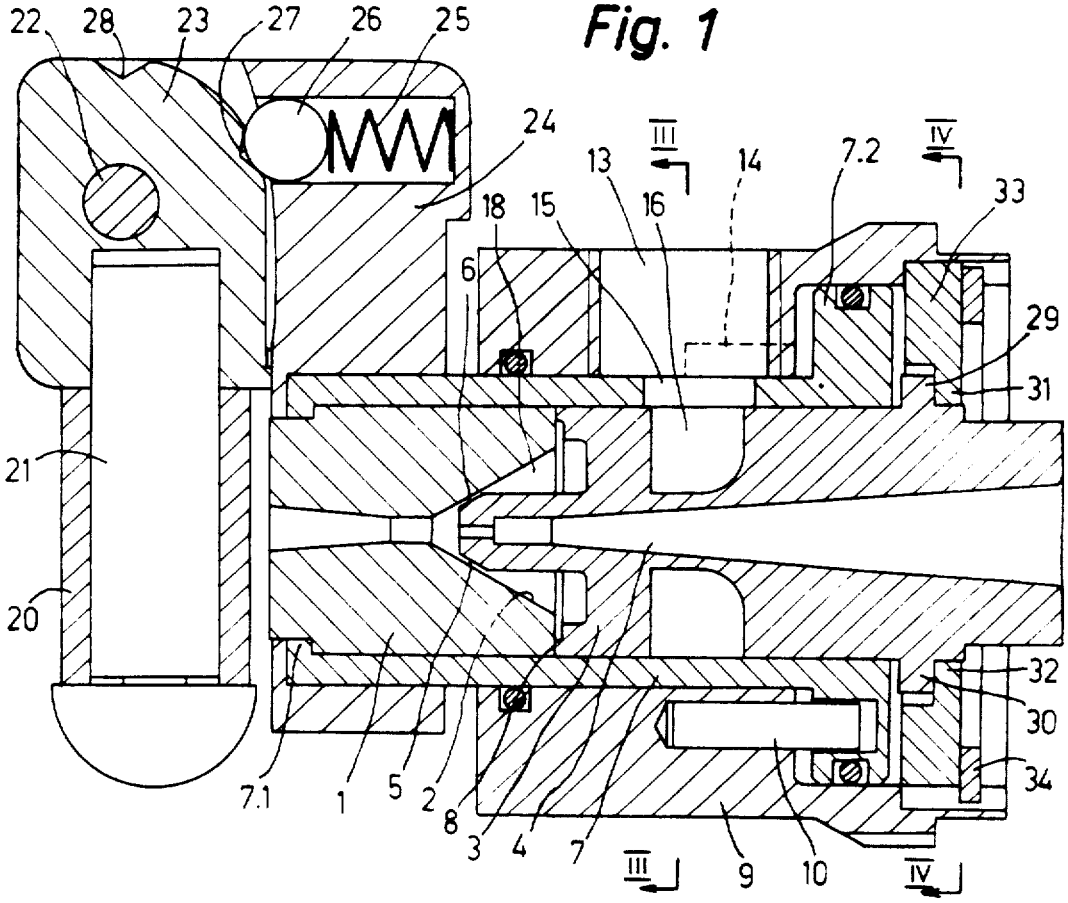

The invention relates to a device for blow-texturing at least one multifilament yarn, with a guide unit containing a through bore having a conical section on one inlet side, and with a needle unit containing a through yarn passage aligned approximately coaxially with the bore of the guide unit, this needle unit extending with one end into the aforementioned conical section and exhibiting on this end a conical peripheral surface forming, with the wall of the conical section, a passage slot for a blowing medium; a feed bore for the blowing medium terminates upstream of the passage slot into the annular chamber surrounding the needle unit, and a baffle unit is mounted on the outlet side of the bore of the guide unit.

For obtaining a satisfactory texturing effect in such a device, a high overfeed is necessary. Overfeed means the ratio between the velocity of the yarn fed through the yarn passage and the take-off speed of the textured yarn exiting from the bore of the guide unit and deflected on the baffle unit. In order to provide for a high overfeed, the passage slot for the blowing medium between the needle unit and the guide unit should, in dependence upon the titer of the yarn, have in each case a predetermined width ranging from about 0.12 to 0.4 mm. With a given yarn titer, the width of the passage slot should always exhibit constantly its optimum value. The precision required for this purpose is, however, difficult to obtain and must be permanently maintained.

Therefore, in known devices of the type discussed hereinabove, the guide unit and/or the needle unit are arranged in an axially adjustable fashion in a housing of the device in order to be able to adjust the width of the passage slot by axial shifting. However, it is practically impossible with these devices to set the width of the passage slot accurately and in a reproducible way to a desired value. Furthermore, there is the danger that the adjustment will change during the course of time.

In general, the invention has the object of fashioning the above-indicated device in such a way that a high and uniform texturing quality is achieved and is also permanently ensured over relatively long periods of time.

In the device according to this invention, the object has been attained by fixing the axial position of the guide unit with respect to the needle unit by urging the guide unit and the needle unit against each other by a force exerted in the axial direction.

The invention thus eliminates the feature of making the guide unit and the needle unit axially adjustable with respect to each other and instead presses the two units against each other with a preferably elastic load of a predetermined magnitude. The result perforce achieved thereby is a passage slot of a predetermined, constant width between the needle unit and the guide unit. Furthermore, it is possible without difficulties to retain the two bodies so that the wall of the conical section of the bore in the guide unit and the conical peripheral surface on the needle unit are exactly coaxial to each other.

For similar reasons of precision and stability, the baffle unit preferably cannot be axially adjusted with respect to the guide unit, either, in order to be able to set the distance between the exit orifice of the bore of the guide unit and the baffle unit. Instead, the baffle unit can be mounted to a holder to be exchangeable and furthermore to be pivotable into a threading position remote from the exit orifice of the bore of the guide unit.

Figure 2:
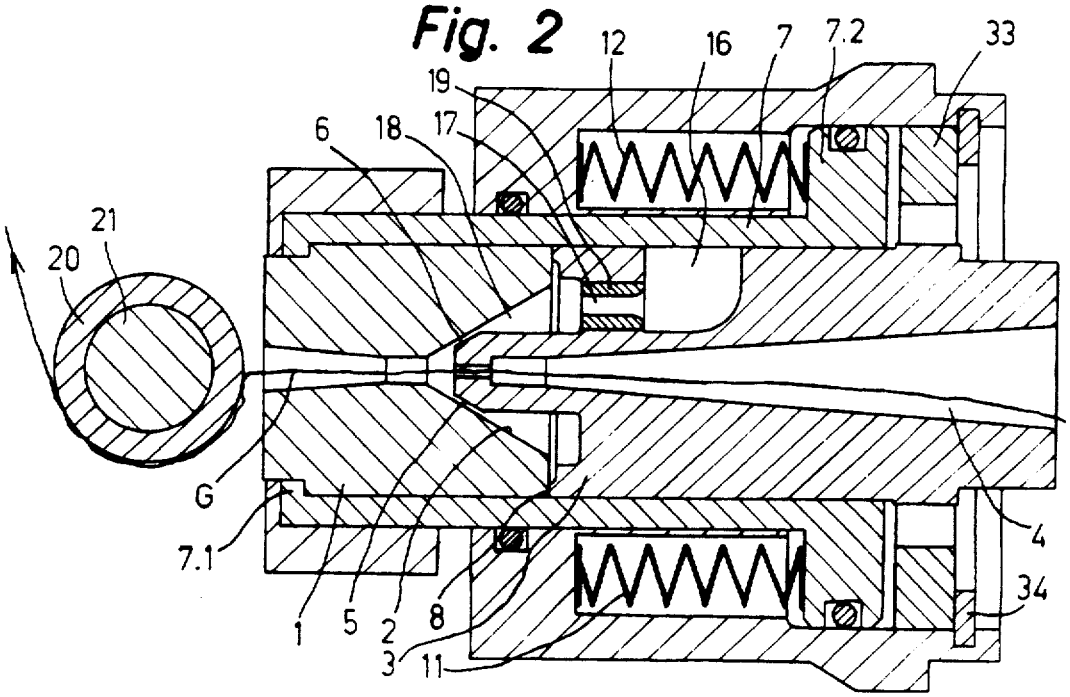
Figure 3:
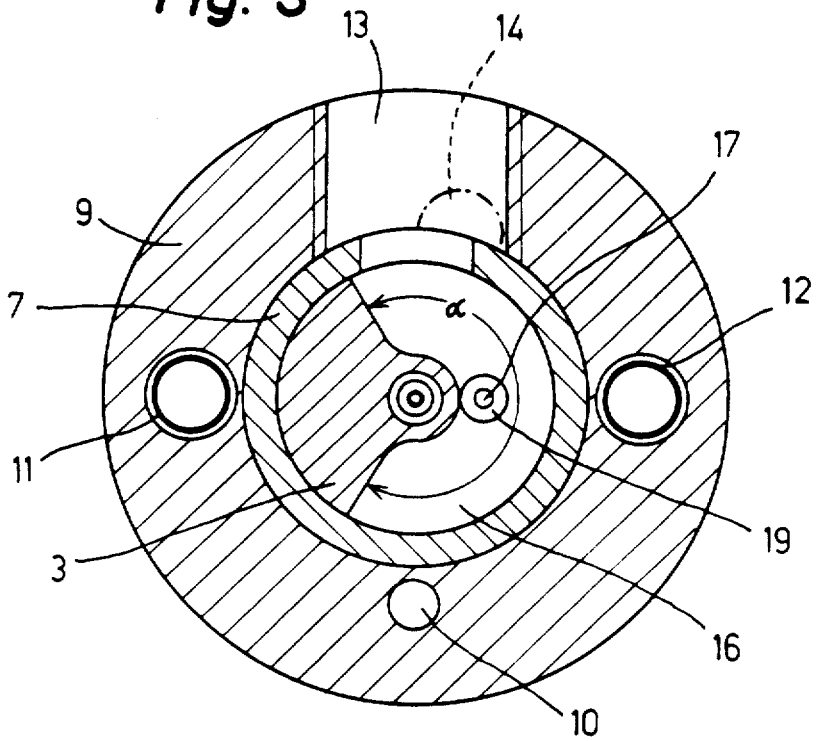
Figure 4:
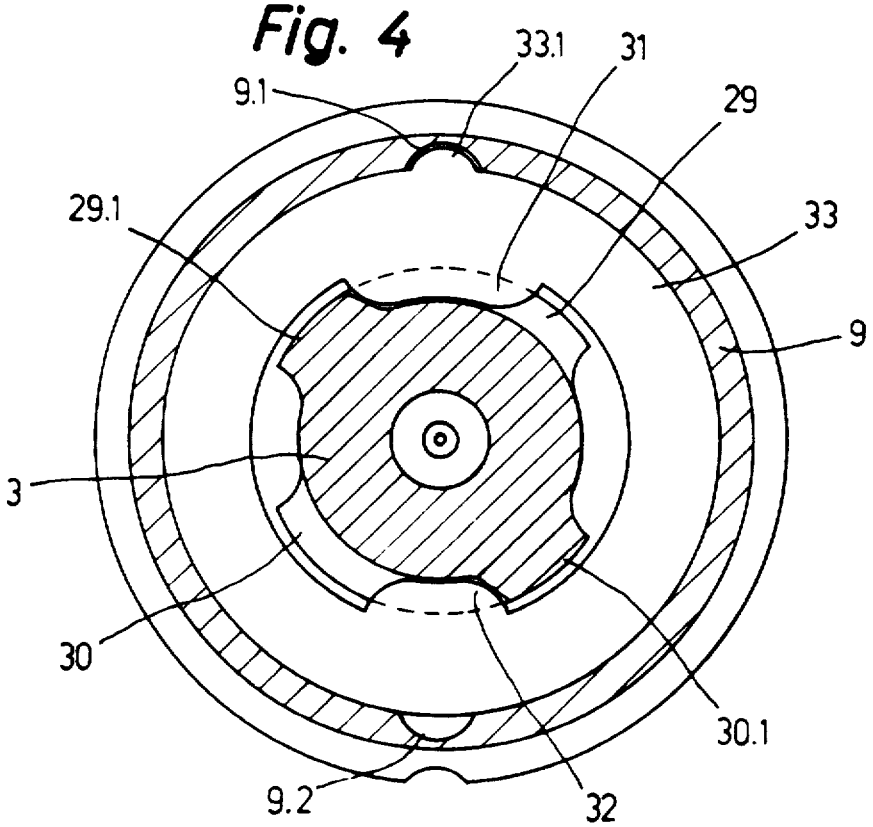
Figure 5:
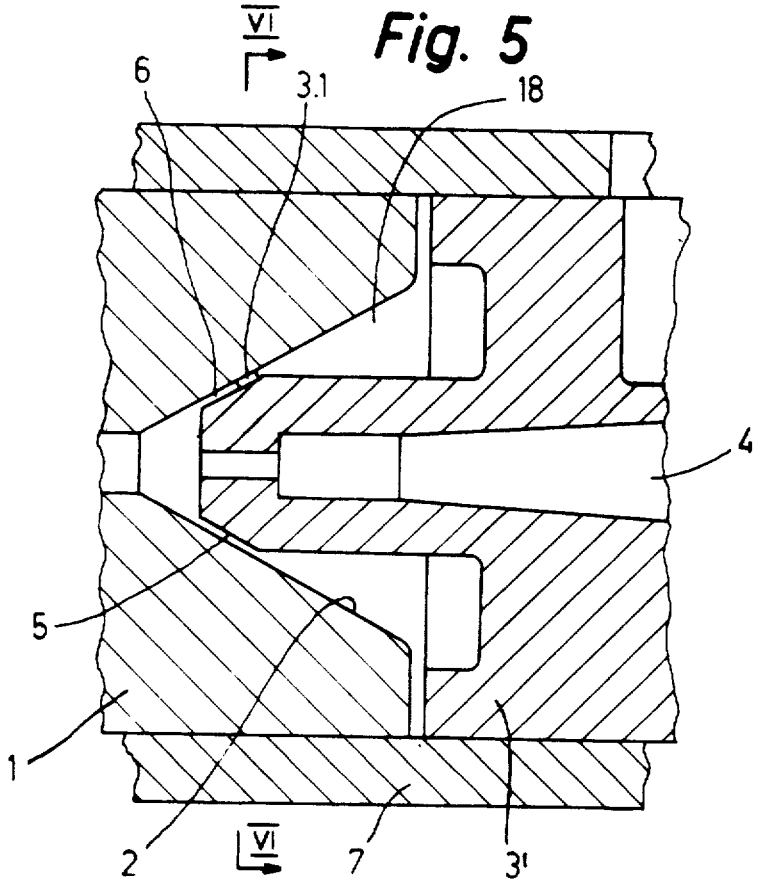
Figure 6:
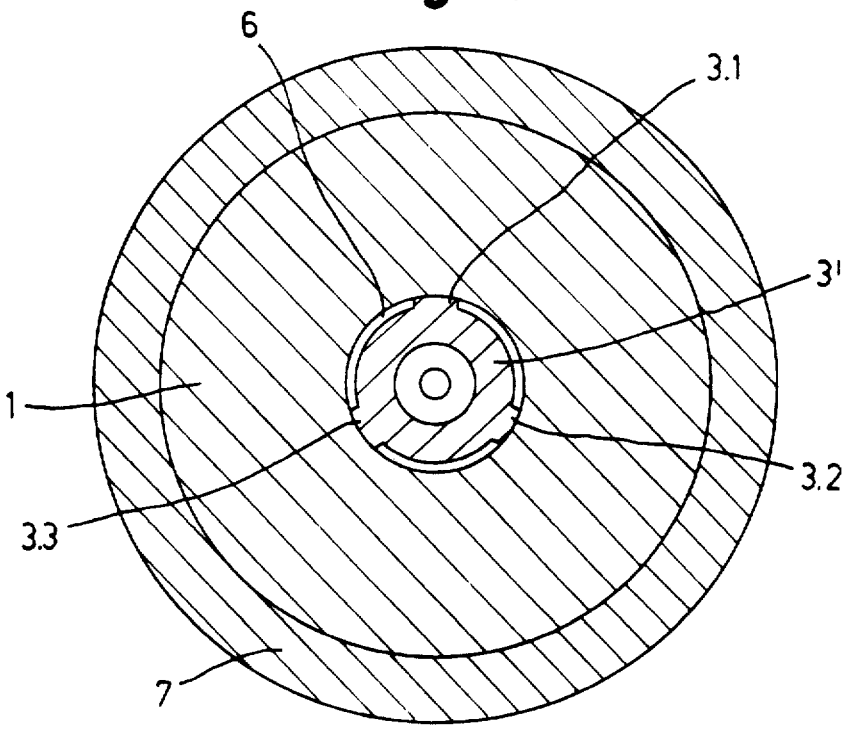
Figure 7:
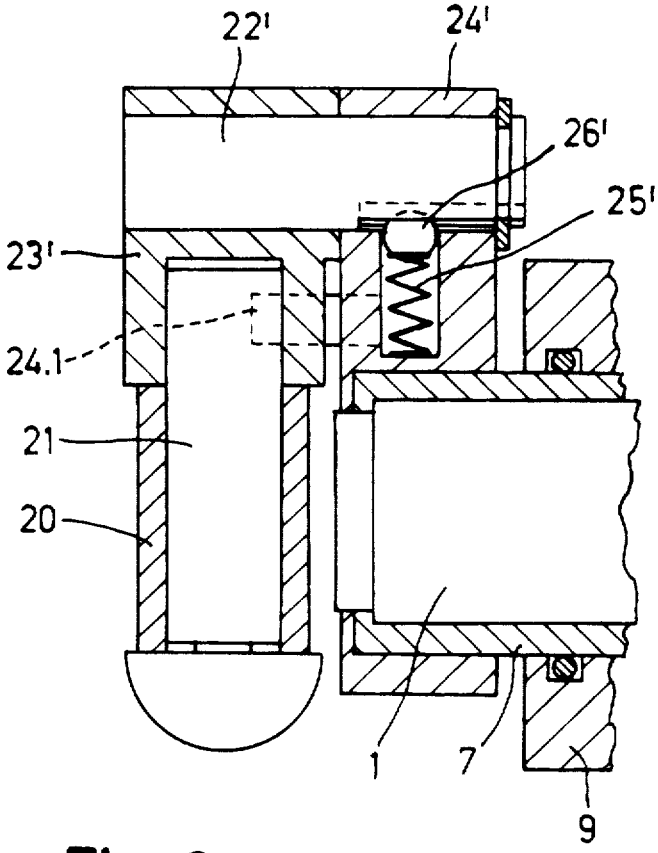
Figure 8:
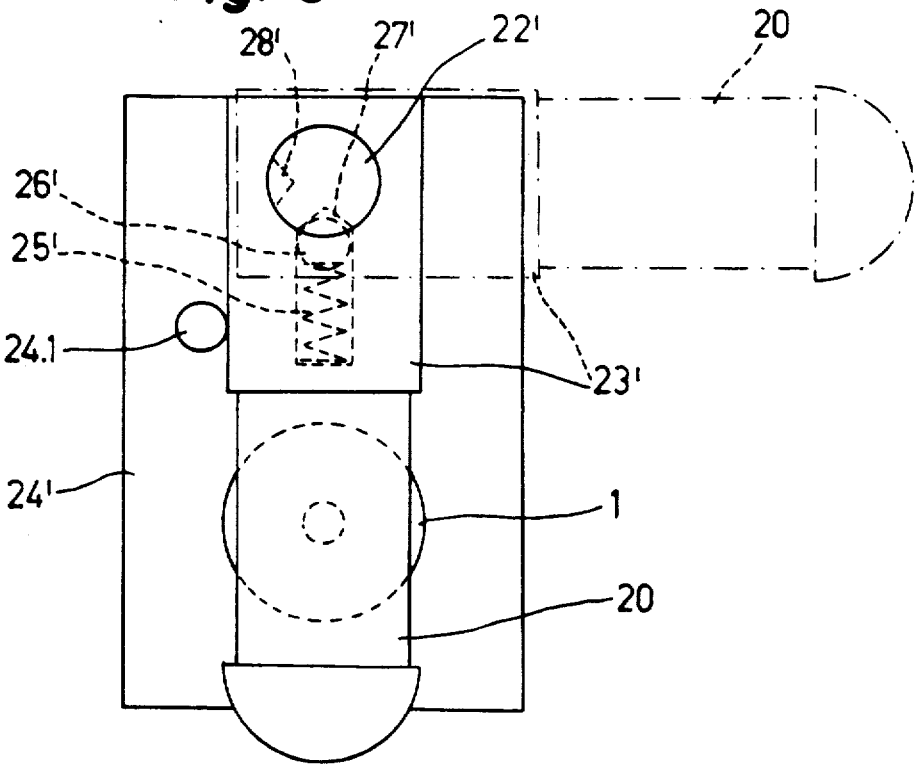

Embodiments of the device according to this invention will be described below with reference to the drawings wherein:

FIG. 1 is a schematic longitudinal section through a blow-texturing device,

FIG. 2 shows a longitudinal section through the device rotated by 90° with respect to FIG. 1, FIG. 3 is a cross section along line III-III in FIG. 1, FIG. 4 is a cross section along line IV-IV in FIG. 1, FIG. 5 shows, in a view corresponding to a detail of FIG. 1, a variation of the device on an FIG. 6 shows a cross section along line VI-VI in FIG. 5, FIG. 7 shows, in a view similar to FIG. 1 —on a somewhat reduced scale—the exit zone of another variation of the blow-texturing device, and FIG. 8 shows a view of the variation according to FIG. 7 as seen from the left-hand side in FIG. 7.

The device for the jet bulking of a multifilament yarn (or simultaneously two or more multifilament yarns) shown schematically in FIGS. 1-4 comprises a guide unit 1, consisting of a ceramic material, for example, containing a continuous bore for the passage of multifilament yarn and blowing medium. This bore exhibits a conical section 2 on one inlet side. The vertex angle of the conical shape ranges, as usual, between 30° and 120°, for example, as shown, at about 60°.

The device furthermore contains a needle unit 3 with a continuously extending yarn channel 4 aligned approximately coaxially with the bore of the guide unit 1. The needle unit 3 extends with one end into the conical section 2 of the bore of the guide unit 1 and exhibits at this end a conical peripheral surface 5 forming, with the wall of the conical section 2, a passage slot 6 for the blowing medium.

The passage slot 6 should have an exactly predetermined width depending on the titer of the yarn to be textured which is fed through the yarn passage 4 and ranging from about 0.12 to 0.4 mm. In order to ensure this exactly predetermined width of the passage slot 6, the axial position of the guide unit 1 with respect to the needle unit 3 is fixed in accordance with this invention by pressing the guide unit 1 and the needle unit 3 against each other by the exertion of a force in the axial direction. In the illustrated embodiment, the guide unit 1 and the needle unit 3 are guided with their peripheral surfaces in a cylindrical sleeve 7 and are in contact with each other, in the preferred version directly, along a circular-ring surface 8. However, it is also possible, if desired, to arrange on the circular-ring surface 8 between the two bodies 1 and 3, for example, a shim of a predetermined thickness which shim can be exchangeable. The annular contact surface 8 could also be conical in order to center the two units 1 and 3 additionally with respect to each other. The guide unit 1 is in contact with a flange 7.1 of the sleeve 7 while the needle unit 3 is retained in a housing 9 guided on the outside of the sleeve 7, for example, as described hereinbelow, by means of a bayonet catch. A pin 10 is seated in a bore in housing 9 and extends into a bore in a flange 7.2 of the sleeve 7 in order to prevent twisting of the housing 9 with respect to the sleeve 7. Compression springs 11 and 12 (FIGS. 2, 3) are arranged in two further bores in the housing 9; these springs are in contact with the flange 7.2 of the sleeve 7 and urge the sleeve 7 toward the right with respect to the housing 9 in FIGS. 1 and 2. In addition, a connecting conduit 14 leads from a compressed-air connection 13 in the housing 9 to the left-hand side of the flange 7.2, acting as a piston, so that the pressure of the introduced blowing air urges the sleeve 7 likewise toward the right with respect to housing 9. (The connecting conduit 14 is not visible in FIG. 3, but its position is indicated herein by means of a dot-dash line.) Thus, in this way, the guide unit 1 in contact with the flange 7.1 of the sleeve 7 is pressed against the needle unit 3, held in the housing 9, by means of an elastic load.

The compressed-air connection 13 of the housing 9 is in communication, via a lateral aperture 15 in the sleeve 7, with a recess 16 in the needle unit 3 extending in the peripheral direction. An axially parallel feed bore 17 for the blowing air emanates from this recess 16 and terminates into the annular chamber 18 surrounding the needle unit 3 upstream of the passage slot 6. A bushing 19 consisting, for example, of hard metal or a ceramic material is arranged in the feed bore 17; this bushing, as illustrated in FIG. 2, exhibits a rounded inlet rim.

On the outlet side of the bore of the guide unit 1, i.e. in the flow direction of the blowing air and in the travel direction of the yarn downstream of the exit orifice of the bore of the guide unit 1, a baffle unit 20 is arranged which has, for example, the shape of a cylindrical sleeve, as illustrated. The sleeve 20 is held exchangeably on a mandrel 21 which latter is seated in a body 23 pivotable about an axle 22. The swivel axle 22 is retained in a holder 24 affixed to the sleeve 7. Furthermore, a compression spring 25 is arranged in a bore in the holder 24 and urges a ball 26 into a locking recess 27 in the body 23. Thereby, the body 23 with the mandrel 21 is fixed in the illustrated operative position wherein the sleeve 20, serving as a baffle member, has a predetermined small distance from the exit orifice of the bore of the guide unit 1. This distance can be varied by exchanging the sleeve 20 against another sleeve with a larger or smaller external diameter. For threading a new multifilament yarn through the yarn passage 4 and the bore of the guide unit 1, the body 23 with the mandrel 21 can be swung—after overcoming the bias of the compression spring 25—about the axle 22 into a threading position wherein the ball 26 locks into a second detent recess 28 in the body 23. The sleeve 20 serving as the baffle member is then at a distance from the guide unit 1 so that a suction gun can be placed in front of its outlet orifice.

In the illustrated embodiment, the needle unit 3, as mentioned above, is held in the housing 9 by means of a bayonet catch. The needle unit 3 carries two radial projections 29 and 30 extending behind two inwardly oriented radial projections 31 and 32, respectively, of a bayonet ring 33 retained in the housing 9. The bayonet ring 33 is releasably arranged in the housing 9 and held, for example, by means of a snap ring 34.

The yarn G leaving the outlet orifice of the bore of the guide unit 1 and impinging upon the baffle unit 20 is deflected on the baffle unit 20 in such a way that it moves away from the axis of the yarn channel 4 and the bore of the guide unit 1, as shown in FIG. 2, in a direction lying approximately in diametrical opposition to the direction from the axis to the air feed bore 17. The yarn G then travels in the view according to FIG. 2 at the bottom around the baffle member 20 and is taken off in the upward direction. In case the thus-described device is arranged in a texturing machine so that the yarn G in the view according to FIG. 2 should travel at the top around the baffle unit 20 and then should be taken off in the downward direction, then the needle unit 3 can be inserted for this purpose in the sleeve 7 in a position which is rotated by 180° about the axis as compared with the illustrated position. This is made possible by the feature that the recess 16 in the needle unit 3 extends approximately symmetrically with respect to the air feed bore 17 in the peripheral direction over an angle $\alpha$ (FIG. 3) of 181°–270° so that this recess 16 will be in communication with the lateral air inlet opening 15 of the sleeve 7 in the illustrated position of the needle unit 3 as well as in the position of the latter which is rotated by 180°. However, in order to take care that the needle unit 3 is not inadvertently inserted in the sleeve 7 with the position rotated by 180°, the bayonet catch can be designed so that the needle unit 3 can only be inserted in one position. As can be seen from FIG. 4, the projection 31 of the bayonet catch 33 is, as measured in the peripheral direction, wider than the projection 32. The projections 29 and 30 of the needle unit 3 have a mutual spacing on one side (on the right-hand side in FIG. 4) corresponding to the width of the projection 31 and have a smaller spacing on the other side (on the left-hand side in FIG. 4) corresponding to the width of the projection 32. The needle unit 3 thus can only be inserted in a position wherein the larger spacing between projections 29 and 30 is aligned with respect to the wider projection 31, and can then be turned by 90° into the position illustrated herein. This turning step is restricted to 90°, for example by means of stops 29.1 and 30.1, respectively, arranged on projections 29 and 30 and cooperating with the projections 31 and 32, respectively. In order to be able to insert the needle unit 3 in the position rotated by 180°, the bayonet ring 33 (after removal of the snap ring 34) must be removed from the housing 9 and reinserted after rotating by 180°. The two positions of the bayonet ring 33, turned by 180° with respect to each other, are fixed, for example, by a cam 33.1 at the bayonet ring 33 received in one of two mutually diametrically opposed recesses 9.1 and 9.2, respectively, in the housing 9.

FIG. 5 shows another version in a view of a detail of FIG. 1 on an enlarged scale. Also in this version, the needle unit 3' is in direct contact with the guide unit 1; the needle unit 3', however, does not contact the end face of the guide unit 1 but rather the wall of the conical bore section 2. Projections 3.1, 3.2, 3.3 are arranged, distributed over the periphery, on the conical peripheral surface 5 of the needle unit 3'; these projections are in contact with the wall of the conical bore section 2. Thus, the width of the passage slot 6 between the peripheral surface 5 and the wall of the bore section 2 corresponds exactly to the height of the projections 3.1, 3.2, 3.3.

In the blow-texturing device described in FIGS. 1–4, the axle 22 about which the baffle unit 20 is pivotable with its mandrel 21 and the body 23 is arranged transversely to the axis of the guide unit 1 and of the needle unit 3, i.e. it intersects this axis approximately perpendicularly. The baffle unit 20 could, of course, also be pivotable about a differently arranged axle between the position at a predetermined small spacing in front of the outlet orifice of the bore of the guide unit and a threading position remote from this outlet orifice. For example, in the version according to FIGS. 7 and 8, the mandrel 21 carrying the sleeve-shaped baffle unit 20 is held in a body 23' which carries a pivot axle 22' which is approximately in parallel to the axis of the guide unit 1. The pivot axle 22' is supported in a holder 24' attached to the sleeve 7. A compression spring 25' is arranged in a bore in the holder 24'; this spring urges a ball 26' into a detent notch 27' in the swivel axle 22'. Thereby the body 23' with the mandrel 21 is fixed in the operating position wherein the body 23' is in contact with a stop 24.1 and the baffle unit 20 is located in front of the outlet orifice of the bore of the guide unit 1. For threading a new multifilament yarn, the body 23' can be swung with the axle 22' into the position shown in FIG. 8 in broken lines wherein the ball 26' engages into a second detent notch 28' in the axle 22'.

I claim:

1. A device for blow-texturing at least one multifilament yarn, with a guide unit (1) containing a through bore having a conical section (2) on one inlet side, and with a needle unit (3; 3') containing a through yarn passage (4) aligned approximately coaxially with the bore of the guide unit (1), this needle unit extending with one end into the aforementioned conical section (2) and exhibiting on this end a conical peripheral surface (5) forming, with the wall of the conical section (2), a passage slot (6) for a blowing medium, wherein the axial position of the guide unit (1) with respect to the needle unit (3;3') is fixed by pressing the guide unit (1) and the needle unit (3;3') together in the axial direction by means of an exerted force, a feed bore (17) for the blowing medium terminating into the annular chamber (18) surrounding the needle unit (3;3') in front of the passage slot (6), and a baffle unit (20) being mounted on the outlet side of the bore of the guide unit (1), wherein the needle unit (3; 3') is displaceably guided in a sleeve (7) and is retained in a housing (9) axailly movable on the sleeve (7) by means of a bayonet catch (29, 30, 31, 32); and that the aforementioned exerted force is produced by springs (11, 12) acting between the housing (9) and the sleeve (7) as well as, during operation, by the pressure of the blowing medium effective upon the sleeve (7) between the housing (9) and a flange (7.2).

2. Device according to claim 1, wherein the guide unit (1) and the needle unit (3; 3') are in direct contact with each other.

3. Device according to claim 2, wherein the guide unit (1) is in contact with the needle unit (3) along an annular surface (8).

4. Device according to claim 2, wherein the guide unit (1) is in contact with the needle unit (3') on projections (3.1, 3.2, 3.3 ) arranged in the passage slot (6).

5. Device according to claim 1, wherein the bayonet catch (29, 30, 31, 32) exhibits radial projections (29, 30) carried by the needle unit (3; 3') with differing spacings or differing widths, and, in a ring (33) connected with the housing (9), passage recesses with differing widths and, respectively, differing mutual spacings, in such a way that the needle unit (3; 3') can be introduced in only one angular position into the sleeve (7) and then is turnable in the sleeve (7) into only one final position.

6. Device according to claim 5, wherein the ring (33) is releasably connected with the housing (9) and can be fixed in the housing (9) in two positions rotated with respect to each other by about 180°.

7. Device according to claim 1, wherein the needle unit (3; 3') exhibits a cylindrical section guided in a sleeve (7) and a central projection of a smaller diameter emanating from an end face of this section and carrying the conical peripheral surface (5), the feed bore (17) being approximately in parallel to the axis of the yarn passage (4) and emanating from a recess (16) in the cylindrical section extending in the peripheral direction, a transverse bore (15) in the sleeve (7) terminating into this recess (16), wherein the recess (16) extends in the peripheral direction over an angle ($\alpha$) of 180°-270° so that the feed bore (17) in the needle unit (3; 3') communicates with the transverse bore (15) in two positions of the needle unit (3; 3') rotated by about 180° with respect to each other.

8. Device according to claim 1, wherein the baffle unit (20) is exchangeable and, being pivotable into a threading position removed from the outlet orifice of the bore of the guide unit (1), is retained on a holder (24; 24') fixed at least axially with respect to the guide unit (1).

9. Device according to claim 1 characterized in that a bushing (19) with a rounded inlet rim is seated in the feed bore (17).

* * * * *